United States Patent [19]

Scarpa et al.

[11] Patent Number: 4,792,071

[45] Date of Patent: Dec. 20, 1988

[54] GARMENT DISPLAY DEVICE

[75] Inventors: Afra B. Scarpa; Tobia Scarpa, both of Trevignano, Italy

[73] Assignee: Benetton S.p.A., Ponzano Veneto, Italy

[21] Appl. No.: 60,035

[22] Filed: Jun. 9, 1987

[30] Foreign Application Priority Data

Mar. 17, 1987 [IT] Italy ..... 21140 B/87[U]

[51] Int. Cl.[4] ..... A41H 5/01

[52] U.S. Cl. ..... 223/68; 223/120

[58] Field of Search ..... 223/61, 66, 68, 74, 223/94, 120

[56] References Cited

U.S. PATENT DOCUMENTS

| | | | |
|---|---|---|---|
| 1,115,567 | 11/1914 | Plannett | 223/68 |
| 2,412,900 | 12/1946 | Mayer | 223/120 X |
| 3,084,837 | 4/1963 | Wolf | 223/68 |
| 3,181,748 | 5/1965 | Wolf | 223/68 |
| 3,294,295 | 12/1966 | Wolf | 223/68 |
| 3,357,610 | 12/1967 | Quinby, Jr. | 223/68 |
| 4,592,496 | 6/1986 | Nishi | 223/68 |

FOREIGN PATENT DOCUMENTS

| | | | |
|---|---|---|---|
| 979148 | 12/1950 | France | 223/68 |
| 612399 | 1/1986 | Japan | 223/120 |
| 139472 | 7/1930 | Switzerland | 223/94 |
| 408630 | 4/1934 | United Kingdom | 223/120 |
| 423113 | 1/1935 | United Kingdom | 223/68 |

*Primary Examiner*—Robert R. Mackey

*Attorney, Agent, or Firm*—Herbert Dubno

[57] ABSTRACT

A coat hanger structure with a variable configuration provided with an accessory-holder mainly for the display of garments in general includes a plurality of tubular elements that can modularly combine in various ways and an upper support element and a lower suport element for the garments, which can be positioned in various ways on a straight portion of one of the tubular elements.

4 Claims, 1 Drawing Sheet

FIG. 2
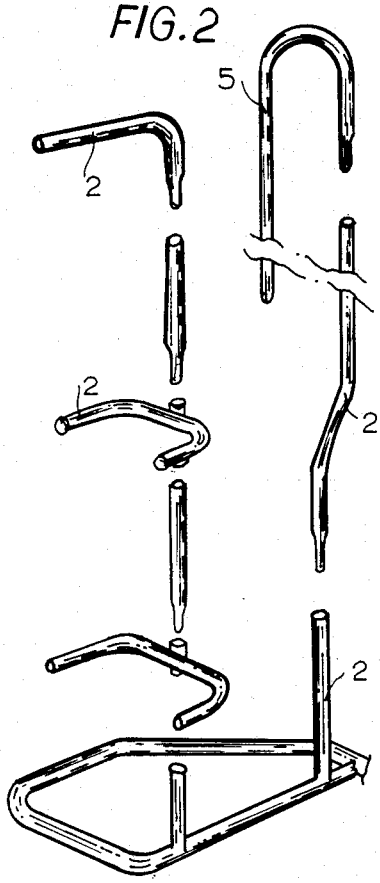
FIG. 1
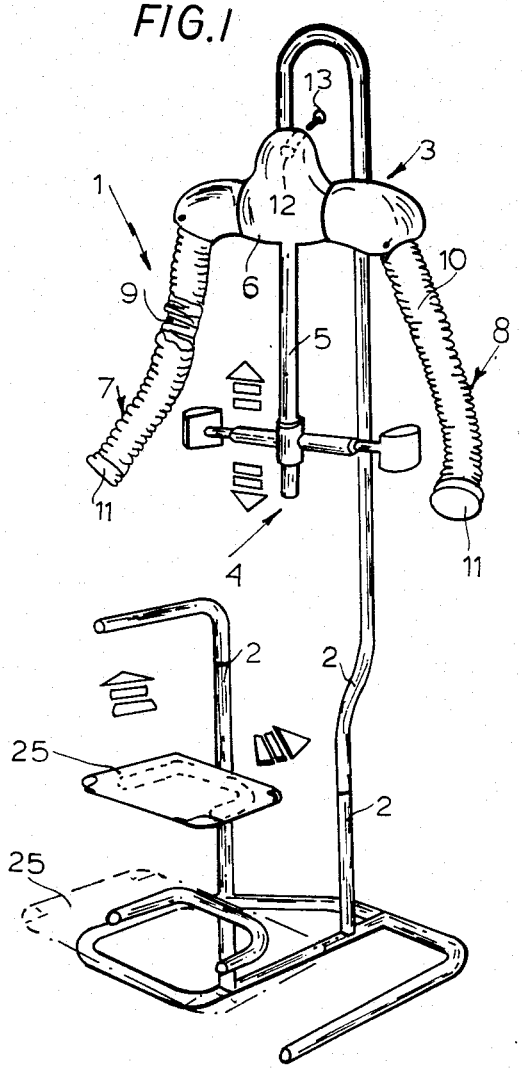
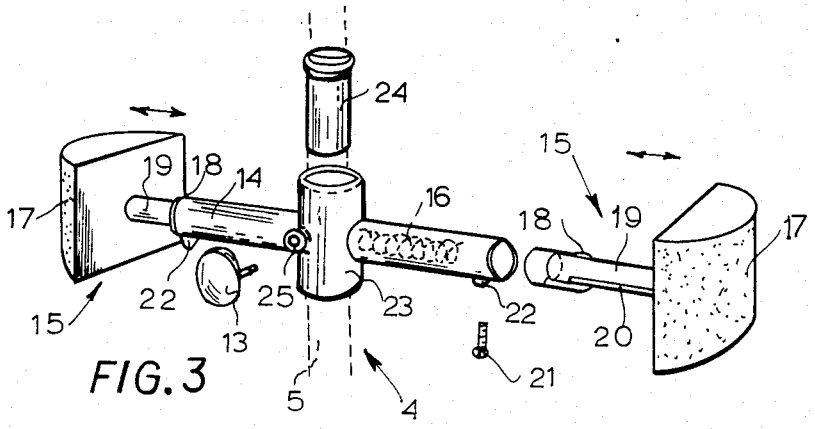
FIG. 3

GARMENT DISPLAY DEVICE

FIELD OF THE INVENTION

The present invention relates to a clothes hanger structure with a variable configuration provided with an accessory holder for the display of garments.

BACKGROUND OF THE INVENTION

Nowadays, in the shops and particularly in shopwindows displaying garments, there is an increasingly growing trend to vary the appearance of a shopwindow in order to appeal more significantly to the passerby or the potential customer.

This involves the use of various coat hangers according to the type, configuration and size of the garments and in relation to the space covered by the latter in the shopwindow or in the shop itself.

Moreover, the object of the current coat hangers is only to support garments while the shopkeepers display in their shopwindow and/or in their shops other items in addition to the garments themselves, such as leather articles or items to wear together with clothes, as accessories.

OBJECT OF THE INVENTION

The object of the invention is to overcome the abovementioned drawbacks by providing a coat hanger structure with a variable configuration having an accessory holder and for the display of garments in general, which can be easily and quickly changed in a limited number of ways, while giving the garment a configuration as close as possible to that which the garment would have if put on a conventional dummy.

A further object of the invention is to provide a coat hanger structure having extremely limited overall dimensions, thus enabling it to be housed even in small spaces.

Another important object of the invention is to provide a coat hanger structure which is extremely simple and functional and is provided with elements or parts supporting accessories.

SUMMARY OF THE INVENTION

These objects are achieved with a coat hanger structure with a variable configuration provided with an accessory holder mainly for the display of garments that can be modularly combined in various ways.

According to the invention, the structure includes an upper support element and a lower support element for such garments, that can be positioned in various ways, such upper and lower support elements being connected respectively to a straight portion of a tubular element.

BRIEF DESCRIPTION OF THE DRAWING

Further characteristics and advantages will be better highlighted in the following detailed description of a coat hanger structure in accordance with the invention, reference being made to the accompanying drawing, in which:

FIG. 1 is a perspective view of the coat hanger structure in accordance with the invention;

FIG. 2 is an exploded view of the coat hanger structure in accordance with the invention defined by a plurality of tubular elements; and FIG. 3 shows a lower support element of the coat hanger structure illustrated in FIG. 1 in accordance with the invention.

SPECIFIC DESCRIPTION

With reference to the FIGURES described above, the coat hanger structure 1 in accordance with the invention includes a plurality of tubular elements 2, that can be modularly combined in various ways and that have variable lengths and dimensions according to the user's needs in order to provide the coat hanger structure with any shape according to the various needs. Moreover, the coat hanger structure 1 includes an upper support element and a lower support element for garments, generally referred to as 3 and 4, respectively, which are removably connected to a straight portion 5 of a tubular element 2.

The upper support element 3 has a rigid central body 6, having a shape substantially similar to a dummy's shoulders and neck, and from its ends two arms extend, referred to as 7 or 8, respectively, each having an internal frame defined by an helicoidally-shaped filiform body 9 so that it permits orientation of the arms in any position of the surrounding space.

The frame defined by the filiform body, is suitably covered with a casting 10 made of flexible and smooth material in order not to damage the garment which is supported by the coat hanger; at the free end of each arm there is a closing pad 11.

The rigid central body is movable along the straight portion 5 of the tubular element and is pivotable around the axis of the same so that it can be oriented in any position and at any level required.

The rigid central body 6 can be affixed to the straight portion by engaging means which includes a threaded hole 12, made in the rear of the central body so that it cannot be seen during the display of garments, into which a screw 13 provided with a knob and engaging the straight portion 5 is threaded.

The lower support element 4 includes two co-axial tubular members 14, which support two pads 15, upon which two springs 16 act.

The pads 15 each include a widened head 17 from which a rod 19 extends. Each rod 19 passes through a sleeve 18 in the respective tubular member.

Moreover, each widened head 17 is coated with a material such as VELCRO ® in order to better adhere to the garment.

Each rod 19 is provided with a longitudinal slot 20 into which a threaded member 21 is engaged to limit travel of the pads 15 without release of the rods 19 from the tubular members 14. The threaded members 21 are screwed into the threaded disks 22. The springs 16 press the rods 19 outwardly to position the pads to the particular size of the garment to be supported. The lower support element 4 also has a central cylindrical body 23 with an axis which is perpendicular to the axis of the tubular members 14 and which internally includes a bushing 24 which can be elastically compressed as a result of the force exerted by a screw provided with a knob 13, threaded into a bore 25 of the body 23, in order to fasten the lower support element on the straight portion 5 without causing any damage to the latter.

At least one of the tubular elements 2 can be structured so that it can support at least one object holder or shelf 25 that can be turned around the journaling axis of the tubular element 2 in parallel to the face of the coat hanger.

The coat hanger structure in accordance with the invention is particularly advantageous because it can be positioned with any orientation and as it has limited overall dimensions, giving also the garment it supports a positioning which is as similar as possible to the shape that can be achieved by using a conventional dummy.

Practically, the materials used as well as the dimensions might be varied according to the needs and to the technical developments.

We claim:

1. A garment-display hanger, comprising:

a tubular structure adapted to stand on a floor and including at least one generally upright tubular element;

an upper garment support mounted on said element and shiftable vertically thereon, said upper garment support including means defining shoulders for supporting shoulder regions of a garment adapted to hang from said upper garment support; and a lower garment support vertically shiftable on said tubular element and spaced below said upper garment support, said lower garment support including:

a central cylindrical body surrounding said tubular element and shiftable vertically along and rotatable about said tubular element, means for fixing said central cylindrical body to said tubular element, a pair of tubular members rigid with said central cylindrical body and extending generally perpendicular to said tubular element in opposite directions away from said central cylindrical body, respective pads guided on said tubular members, each of said pads having a rod received slidably in the respective tubular member, and an enlarged head on the respective rod engageable with the garment, a respective spring in each of said tubular members braced against the respective pad and urging said pads away from said central cylindrical body to permit said pads to accommodate automatically to the size of the garment engaged thereby, and means for limiting the displacement of said pads outwardly by said springs, and wherein said means for fixing said central cylindrical body to said tubular element includes:

an elastically deformable bushing received between said central cylindrical body and said tubular element, and a screw member threaded into said body and bearing upon said bushing to clamp said body and said bushing against said tubular element;

said enlarged heads are each covered with a fabric-gripping material, and said means for limiting the displacement of said pads includes:

a slot formed in each of said rods, and a respective screw member threaded into each of said members and engaging in the respective slot.

2. The garment-display hanger defined in claim 1 wherein said upper garment support comprises:

a central rigid body formed with said shoulders and traversed by said tubular element so that said central rigid body of said upper support is rotatable around and shiftable vertically along said tubular element;

a screw member threaded into said central rigid body of said upper support for affixing same to said tubular element;

respective arm-forming members extending from said shoulders and formed from:

respective coils of filiform material, respective flexible casings covering said coils, and respective closing pads closing ends of said casings remote from said shoulders.

3. The garment-display hanger defined in claim 2 wherein said tubular structure is provided with an upright element carrying a substantially horizontal object-holder shelf rotatable about a vertical axis.

4. The garment-display hanger defined in claim 1 wherein said tubular structure is provided with an upright element carrying a substantially horizontal object-holder shelf rotatable about a vertical axis.

* * * * *